US005201509A

United States Patent [19]

Kirchhoff et al.

[11] Patent Number: 5,201,509

[45] Date of Patent: Apr. 13, 1993

[54] METHOD AND DEVICE FOR CONTROLLING A DRIVE UNIT OF A PILE-LIFTING DEVICE AT A SHEET-FED PRINTING MACHINE

[75] Inventors: Stephan Kirchhoff, Birkenau; Helmut Meyer, Weinheim; Christian Thomas, Walldorf, all of Fed. Rep. of Germany

[73] Assignee: Heidelberger Druckmaschinen AG, Heidelberg, Fed. Rep. of Germany

[21] Appl. No.: 721,955

[22] Filed: Jun. 27, 1991

[30] Foreign Application Priority Data

Jun. 27, 1990 [DE] Fed. Rep. of Germany ..... 4020429

[51] Int. Cl.[5] ..... B65H 1/26

[52] U.S. Cl. ..... 271/157; 271/162; 414/924; 414/925; 388/827

[58] Field of Search ..... 271/22, 24, 30.1, 126, 271/128, 157, 162, 147; 414/924, 925, 926; 187/17; 388/432

[56] References Cited

U.S. PATENT DOCUMENTS 4,455,115 6/1984 Alger et al. ..... 414/924
4,466,604 8/1984 Kishimoto et al. ..... 271/157 X
5,123,079 6/1992 Tanii et al. ..... 388/827
5,123,637 6/1992 Musaka ..... 271/157 X

FOREIGN PATENT DOCUMENTS 0295327 12/1988 Japan ..... 271/157

*Primary Examiner*—H. Grant Skaggs
*Assistant Examiner*—Carol Lynn Druzbick
*Attorney, Agent, or Firm*—Herbert L. Lerner; Laurence A. Greenberg

[57] ABSTRACT

A method of controlling a drive unit of a pile-lifting device located at a sheet-fed printing machine includes starting-up the drive unit with a first mode of operation selected by an electronic current wherein rated torque is high and rated speed is low for respectively lifting and lowering the pile and, after a given period of time, following the starting-up of the drive unit, switching to a second mode of operation of the drive unit wherein the rated torque is low and the rated speed is high if the speed has exceeded a preset value during a lifting of the pile, and has not exceeded a preset value during a lowering of the pile; and a device for performing the method.

4 Claims, 4 Drawing Sheets

Figure 1:
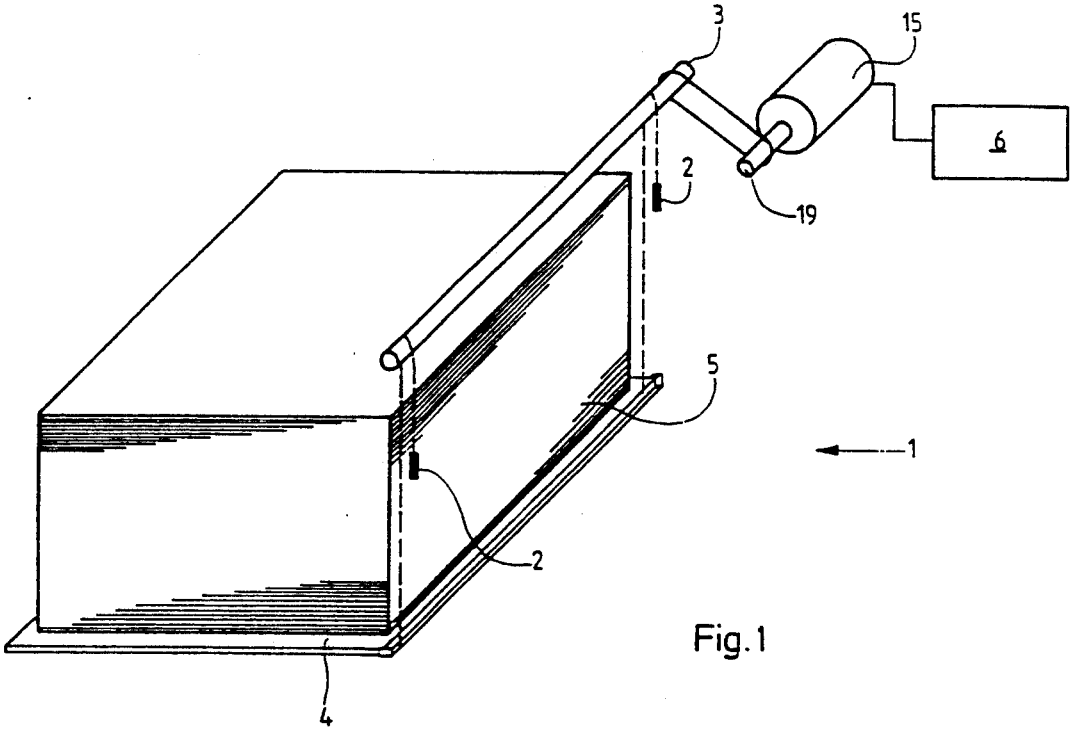

METHOD AND DEVICE FOR CONTROLLING A DRIVE UNIT OF A PILE-LIFTING DEVICE AT A SHEET-FED PRINTING MACHINESpecification The invention relates to a method and device for controlling a drive unit of a pile-lifting device at a sheet-fed printing machine.

A drive unit of a pile-lifting device should basically accelerate and brake gently and smoothly so that the individual paper sheets of the pile do not shift or become misaligned. Nevertheless, the braking distance should be as short as possible. In addition, it is necessary for the pile to be processed quickly in order to achieve a high operating speed of the printing machine.

It is accordingly an object of the invention to provide a method and device for controlling such a drive unit, which satisfies the afore-mentioned requirements appropriately and as simply as possible.

With the foregoing and other objects in view, there is provided, in accordance with the invention, a method of controlling a drive unit of a pile-lifting device located at a sheet-fed printing machine, which comprises starting-up the drive unit with a first mode of operation selected by an electronic current wherein rated torque is high and rated speed is low for respectively lifting and lowering the pile and, after a given period of time following the starting-up of the drive unit, switching to a second mode of operation of the drive unit wherein the rated torque is low and the rated speed is high if the speed has exceeded a preset value during a lifting of the pile, and has not exceeded a preset value during a lowering of the pile.

The invention makes use of the fact that for a great pile height, the drive requires great torques, yet the distance to be covered or overcome are short, whereas, for a low pile height, a low torque is required at higher speeds. Moreover, the method and device according to the invention is distinguished by requiring relatively low expenditure, e.g., it needs no force sensor, for example. An adjustment to the respective pile height is effected both during pile lifting as well as during pile lowering.

In accordance with another measure of the invention, the method includes, during the pile lifting, switching back to the first mode after a given period of time, if the speed has not exceeded a further given value. This measure of the invention ensures that the circuit switches back to the first mode, if the second mode generates a torque which is not great enough for the respective pile height.

In accordance with another aspect of the invention, there is provided a device for performing a method of controlling a drive unit of a pile-lifting device located at a sheet-fed printing machine, comprising electronic circuit means for operating the drive unit in a first mode wherein rated torque is high and rated speed is low for respectively lifting and lowering a pile of sheets and, after a given time period, for switching to a second mode of operation of the drive unit wherein the rated torque is low and the rated speed is high if the speed has exceeded a preset value during a lifting of the pile, and has not exceeded a preset value during a lowering of the pile.

In accordance with a concomitant feature of the invention, the motor has a commutatable winding.

Other features which are considered as characteristic for the invention are set forth in the appended claims.

Although the invention is illustrated and described herein as embodied in a method and device for controlling a drive unit of a pile-lifting device at a sheet-fed printing machine, it is nevertheless not intended to be limited to the details shown, since various modifications and structural changes may be made therein without departing from the spirit of the invention and within the scope and range of equivalents of the claims.

Figure 2A:
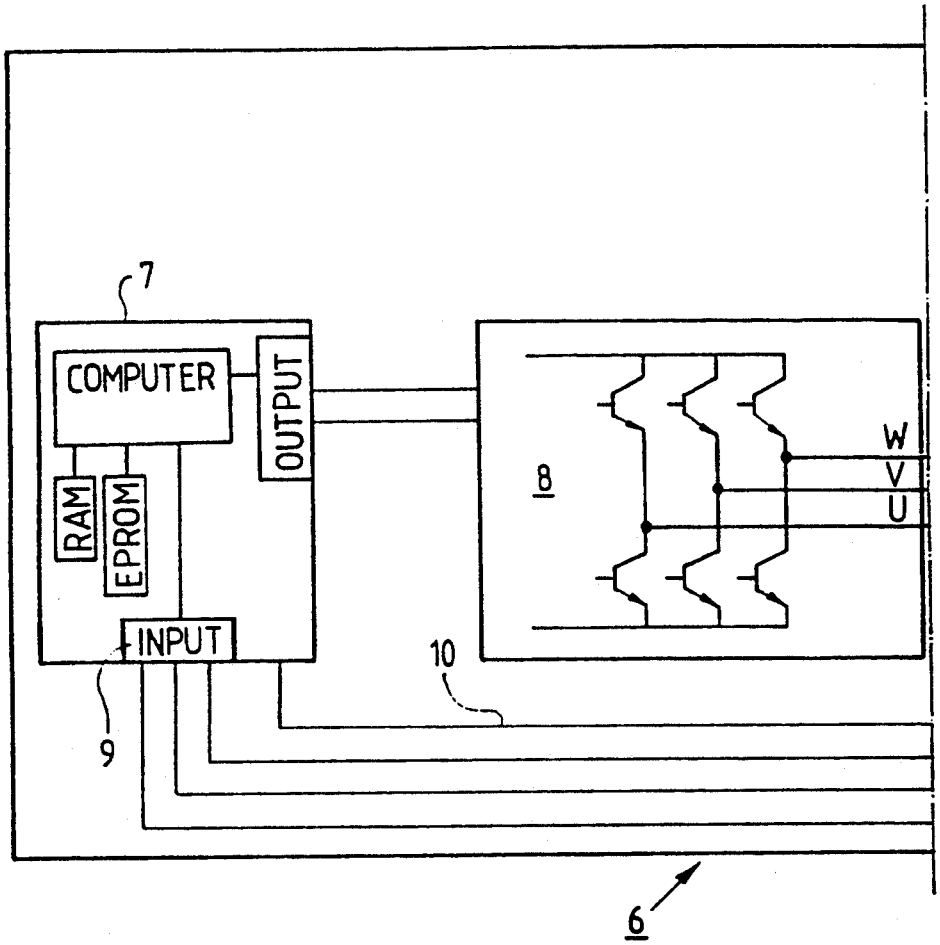
Figure 2B:
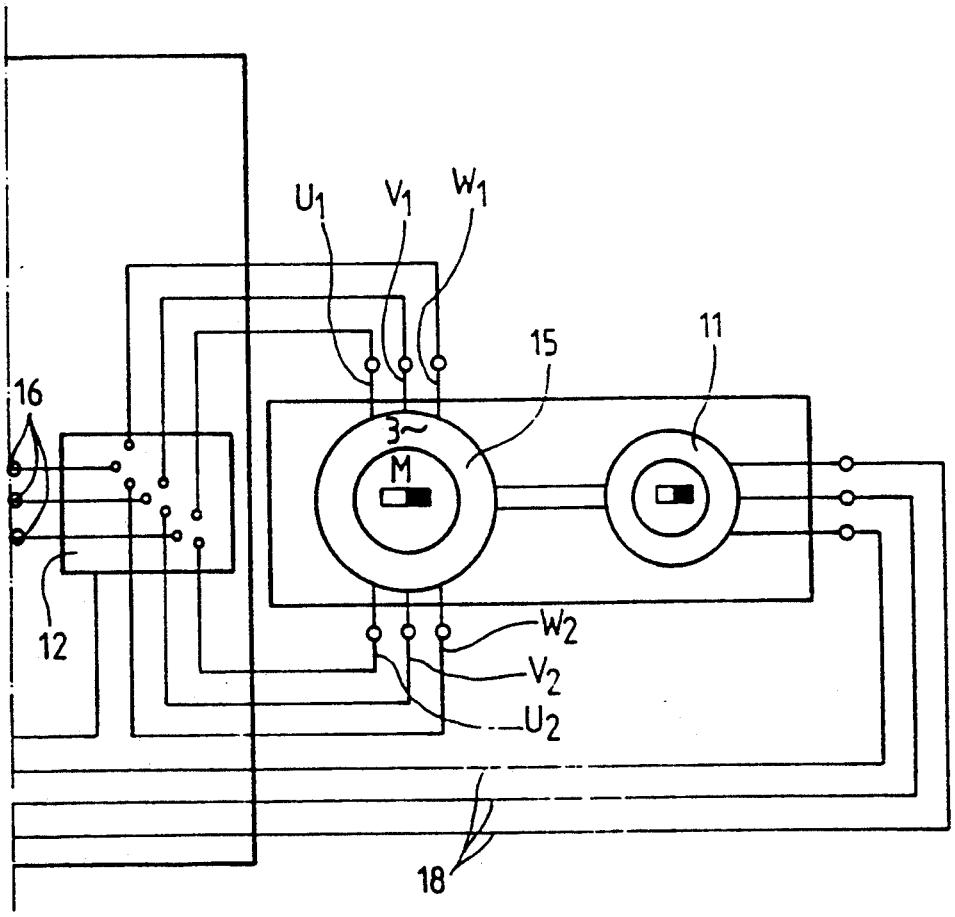
Figure 3:
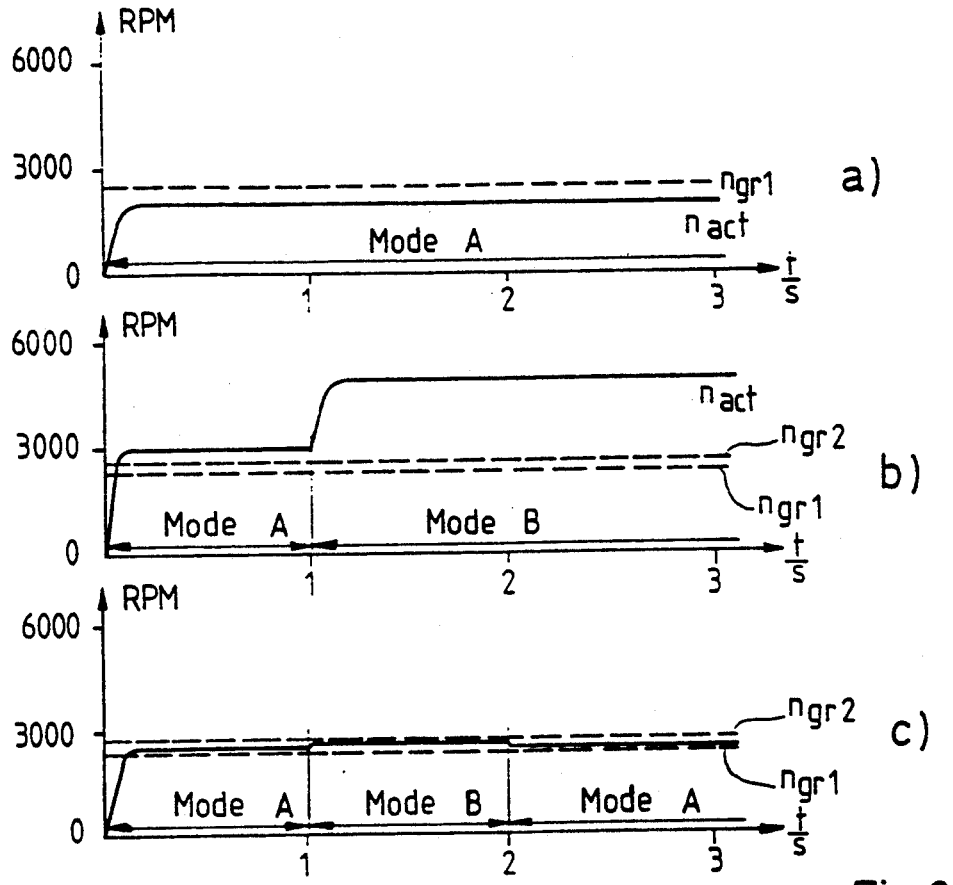
Figure 4:
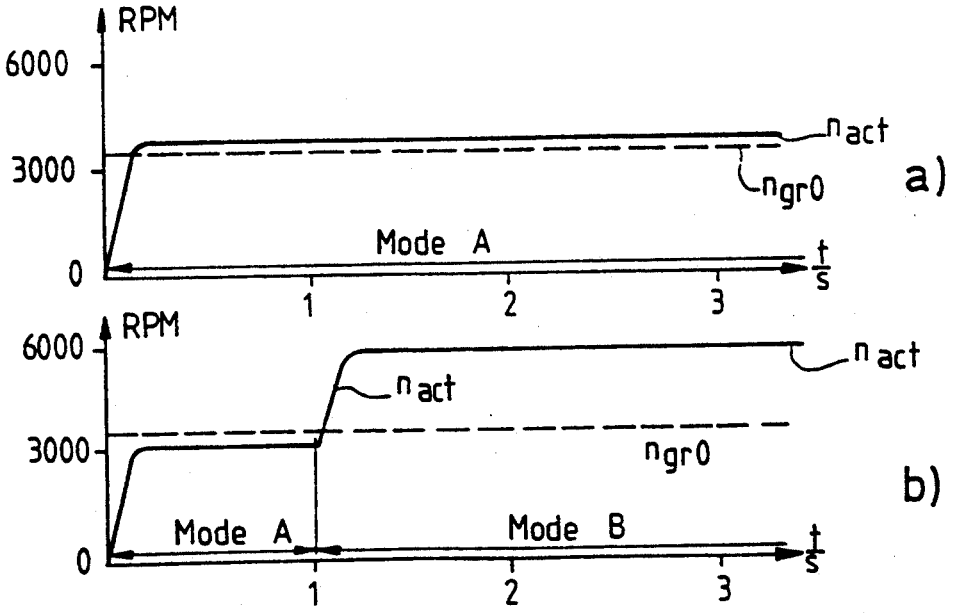

The construction and method of operation of the invention, however, together with additional objects and advantages thereof will be best understood from the following description of specific embodiments when read in connection with the accompanying drawings, in which:

FIG. 1 is a diagrammatic and schematic perspective view of a sheet pile lifting device, according to the invention;

FIGS. 2*a* and 2*b* are respective left-hand and right-portions of a block diagram of the device according to the invention;

FIGS. 3 *a*), *b*) and *c*) are plot diagrams of the time rate of change of the rotary speed of the drive motor of the invention for three different operating phases during sheet pile lifting, and FIGS. 4 *a*) and *b*) are plot diagrams of the time rate of change of the rotary speed of the drive motor for two different operating phases during sheet pile lowering.

In the figures of the drawing, like parts are identified by the same reference characters.

Referring now to the drawing with greater particularity, there is shown in FIG. 1 a pile-lifting device 1 formed primarily of a pile board 4 holding an actual pile of sheets 5. A drive unit in the form of a motor 15 which is provided with an electronic circuit 6 lifts and lowers the pile, the motor 15 having a drive shaft 19 connected to a shaft 3 for rotating the latter. Counterweights 2 suitably carried by chains connected to the pile board 4 tend to tighten the loose chain ends.

The electronic circuit 6 which is connected to the motor 15 and is shown in FIG. 2 includes a control system 7 in the form of a computer, for example, a power source 8 and a relay 12. In the particular embodiment of the invention represented in FIG. 2, the motor 15 has two windings respectively having inputs U1, V1, W1, on the one hand, and U2, V2, W2, on the other hand. Moreover, Hall sensors are provided as rotor position detectors 11 which transmit signals accordingly to a rotary-speed determining section 9 of the control system or computer 7 via lines 18. It is also conceivable to employ other rotary-speed determining devices such as conventional optical devices, for example.

Depending upon the required torque, the two windings of the motor 15 are supplied with power via the control system 7, the power source unit 8, as well as the winding commutation relay 12. The outputs U, V, W of the power source 8 are connected to inputs 16 of the relay 12. Furthermore, a winding commutation line 10 is provided between the control system 7 and the relay 12.

The control for respectively lifting and lowering the pile 4,5 is described hereinafter.

1. Lifting the pile 4,5

FIG. 3 is a series of plot diagrams a), b) and c) representing curves of the speed $n_{act}$ within a few seconds after the motor 15 for lifting the pile 4,5 has been switched on. FIG. 3*a*) shows the speed $n_{act}$ curve for a relatively great pile height, i.e. with the pile 4,5 representing a great weight, FIG. 3*b*) shows the speed $n_{act}$ curve for a low pile height and FIG. 3*c*) shows the speed $n_{act}$ for an average pile height. Mode A signifies a high rated torque and a low rated speed, mode B a low rated torque and a high rated speed.

At the relatively great pile height of FIG. 3*a*), the speed $n_{act}$ does not reach a threshold value $n_{gr1}$. Thus, the circuit of FIG. 2 does not commutate from one winding to the other. At a relatively lower pile height (FIG. 3*b*)) the actual speed $n_{act}$ exceeds the threshold value $n_{gr1}$, however, so that, after a period of one second, the circuit commutates to a high-speed winding, with the actual speed $n_{act}$ also increasing accordingly. In FIG. 3*c*), the weight of the pile 4,5 is just great enough so that the threshold value $n_{gr1}$ is barely exceeded with operating mode A. When a switch-over to mode B occurs, the rated torque of the motor 15 becomes so low that the speed $n_{act}$ does not exceed a further threshold value $n_{gr2}$. In this case, the circuit switches back to mode A after another second.

2. Lowering the pile

The pile-lowering steps are illustrated in FIG. 4 wherein a) represents the curve of the speeds for a relatively great pile height, whereas b) represents the curve for a relatively low pile height. At a respectively great pile height, the speed $n_{act}$ exceeds the preset value $n_{gr0}$, no commutation from one mode to the other being effected. If the weight of the pile is so low that the speed $n_{act}$ does not exceed the preset value $n_{gr0}$, however, the circuit switches to mode B, namely to a high-speed winding.

We claim:

1. Method of controlling a drive unit of a pile-lifting device located at a sheet-fed printing machine, which comprises starting-up the drive unit with a first mode of operation selected by an electronic current wherein rated torque is high and rated speed is low for respectively lifting and lowering the pile and, after a given period of time following the starting-up of the drive unit, switching to a second mode of operation of the drive unit wherein the rated torque is low and the rated speed is high if the speed has exceeded a preset value during a lifting of the pile, and has not exceeded a preset value during a lowering of the pile.

2. Method according to claim 1, which includes during the pile lifting, switching back to the first mode after a given period of time, if the speed has not exceeded a further given value.

3. Device for performing a method of controlling a drive unit of a pile-lifting device located at a sheet-fed printing machine, comprising electronic circuit means for operating the drive unit in a first mode wherein rated torque is high and rated speed is low for respectively lifting and lowering a pile of sheets and, after a given time period, for switching to a second mode of operation of the drive unit wherein the rated torque is low and the rated speed is high if the speed has exceeded a preset value during a lifting of the pile, and has not exceeded a preset value during a lowering of the pile.

4. Device according to claim 3, wherein the drive unit is a motor having a commutatable winding.

* * * * *